US006129239A

United States Patent [19]

Fukazawa

[11] Patent Number: 6,129,239

[45] Date of Patent: Oct. 10, 2000

[54] POCKET TISSUE HOLDER WITH ADDITIONAL HOLDING CAPABILITY

[76] Inventor: Noriko Fukazawa, 4-1, Suido 1-chome, Bunkyo-ku, Tokyo, Japan

[21] Appl. No.: 09/097,705

[22] Filed: Jun. 16, 1998

[30] Foreign Application Priority Data

Jun. 17, 1997 [JP] Japan ..... 9-005655

[51] Int. Cl.[7] ..... B65H 1/00

[52] U.S. Cl. ..... 221/61; 221/34; 206/449

[58] Field of Search ..... 221/33, 34, 46, 221/61, 62; 206/449

[56] References Cited

U.S. PATENT DOCUMENTS

| | | | |
|---|---|---|---|
| 2,541,933 | 2/1951 | Nail | 221/61 |
| 2,826,230 | 3/1958 | Conell | 221/46 |
| 3,459,329 | 8/1969 | Mochizuki et al. | 221/34 |
| 5,551,595 | 9/1996 | Mertens et al. | 221/45 |

*Primary Examiner*—H. Grant Skaggs
*Attorney, Agent, or Firm*—Greenblum & Bernstein, P.L.C.

[57] ABSTRACT

A pocket tissue holder comprises an upper material with a slit where tissue papers are taken out from a tissue paper container part, and a lower material, having the same width as that of the upper material, which is longer than the upper material. Both edges of the upper material in the horizontal direction are not attached to the lower material and serve as supply inlets so that tissue papers can be inserted therefrom. A pocket for keeping small articles is constructed with the edge part of the lower material in the horizontal direction, and a pocket material which is placed over the lower material. A take-out opening of the pocket is facing toward the center of the pocket tissue holder, and is arranged perpendicular to the take-out slit. According to such a structure, it is possible to obtain a pocket tissue holder with more convenient applications.

3 Claims, 6 Drawing Sheets

POCKET TISSUE HOLDER WITH ADDITIONAL HOLDING CAPABILITY

BACKGROUND OF THE INVENTION

The present invention relates to a pocket tissue holder particularly to that which is suitable for a portable use and having an additional holding capability.

Description of the Related Art

With respect to conventional pocket tissue holders, most typical ones are for holding a pack of tissue papers of a pocket size which usually come in a small plastic bag. On the other hand, it should be difficult to find such pocket tissue holders for holding tissue papers which usually come in a rectangular cardboard box and not suitable for a portable use. Since a typical pack of pocket tissue papers only contains a small number of tissue papers which are folded into small pieces, when a large number of tissue papers are needed, one would have to carry a number of such tissue packs. One example of such case requiring a lot of tissue papers would be the case in which a mother is outside carrying an infant.

According to the conventional case, there are several disadvantages such that getting supplied from a pack of pocket tissues would be uneconomical, and that the tissue papers have to be unfolded every time they are taken out to be used. Another disadvantage is that when in need of a lot of tissue papers, one would have to carry a number of tissue packs, which takes up a lot of space. Again, such cases requiring a lot of tissue papers in addition to the above case in which a mother is outside carrying an infant, would be the cases in which one is suffering an allergic congestion, one is on a camp or a trip, etc. Furthermore, under conventional conditions, for example, additional goods such as diapers which are rather big in size have to be carried separately. In addition, with respect to conventional tissue holders which are made for holding box tissue papers which are folded in two, they would not usually have pockets for keeping additional goods or small articles.

SUMMARY OF THE INVENTION

The present invention has been achieved with such points in mind, and it is therefore an object of the present invention to provide a pocket tissue holder with more convenient applications.

According to a first aspect of the invention, there is provided a pocket tissue holder having a take-out slit for taking out tissue papers, capable of having the tissue papers folded in a predetermined size or form in keeping them inside, comprising: a supply inlet from which the tissue papers are inserted, provided on either one edge or both edges of the pocket tissue holder.

According to a second aspect of the invention, there is provided a pocket tissue holder according to the first aspect, wherein: the supply inlet is provided to either one edge or both edges of the pocket tissue holder in the horizontal direction, the supply inlet arranged perpendicular to the pocket tissue holder's horizontal length, having approximately the same length as the pocket tissue holder's vertical width.

According to a third aspect of the invention, there is provided a pocket tissue holder according to the first aspect, wherein: the supply inlet is provided to either one edge or both edges of the pocket tissue holder in the vertical direction, having a suitable length sufficient for having the tissue papers to be inserted from.

According to a fourth aspect of the invention, there is provided a pocket tissue holder according to the first aspect, further comprising: a pocket for keeping small goods or articles provided either on one edge or both edges of the pocket tissue holder in the horizontal direction.

According to a fifth aspect of the invention, there is provided a pocket tissue holder having a take-out slit for taking out tissue papers, capable of having the tissue papers folded in a predetermined size or form in keeping them inside, comprising: an upper material where the take-out slit is provided; and a lower material having approximately the same width and length as the upper material, the upper and the lower materials being attached to each other by their edges in the horizontal direction while their edges in the vertical direction are not attached to each other so as to form tissue supply inlets from which tissue papers are inserted.

According to a sixth aspect of the invention, there is provided a pocket tissue holder having a take-out slit for taking out tissue papers, capable of having the tissue papers folded in a predetermined size or form in keeping them inside, comprising: an upper material where the take-out slit is provided; and a lower material having approximately the same width and length as the upper material, the upper and the lower materials being attached to each other by their edges in the vertical direction while their edges in the horizontal direction are not attached to each other so as to form tissue supply inlets from which tissue papers are inserted.

According to a seventh aspect of the invention, there is provided a pocket tissue holder according to the fifth or the sixth aspect, further comprising: pockets formed on the surface of the upper material at both edges in the horizontal direction, a take-out opening of the pocket provided as facing toward the center where the take-out slit is provided, and as being perpendicular to the take-out slit.

According to an eighth aspect of the invention, there is provided a pocket tissue holder according to the sixth or the seventh aspect, wherein: both edges of the upper material and the lower material in the vertical direction are attached to each other only as to predetermined portions in the right and the left, the predetermined portions being symmetrical to each other with respect to the center of the horizontal length, the edge of the upper material in the horizontal direction not attached to the lower material is pulled out from beneath the pocket material in inserting the tissue papers.

According to a ninth aspect of the invention, there is provided a pocket tissue holder comprising: an upper material where a take-out slit is provided from which tissue papers are taken out one by one; a lower material having approximately the same vertical width as that of the upper material, a pocket material having approximately the same vertical width as that of the lower material, which serves to construct together with the lower material a pocket for keeping small goods or articles; wherein, the take-out slit is arranged at a center of the upper material as a horizontal slit such that two sections of the slit which are divided by an unseen vertical line passing through a middle point of the upper material's horizontal length are symmetrical to each other with respect to the vertical line, the lower material is arranged as being longer than the upper material by a predetermined length, the upper material is arranged such that two sections of the upper material which are divided by an unseen vertical line passing through a middle point of the lower material's horizontal length are symmetrical to each other with respect to the vertical line, the pocket is provided on the lower material, on the surface where the upper material is attached, the take-out opening of the pocket is facing toward the center where the take-out slit is provided and is arranged as being perpendicular to the slit, while being positioned a little further toward the edge of the pocket tissue holder in the horizontal direction as compared with the edge of the take-out slit, the upper and the lower materials have both edges in the vertical direction attached to each other while they have both edges in the horizontal direction not attached to each other so that they can serve as supply inlets where tissue papers are inserted.

According to a tenth aspect of the invention, there is provided a pocket tissue holder comprising: an upper material where a take-out slit is provided from which tissue papers are taken out one by one; a lower material having approximately the same vertical width as that of the upper material, a pocket material having approximately the same vertical width as that of the lower material, which serves to construct together with the lower material a pocket for keeping small goods or articles; wherein, the take-out slit is arranged at a center of the upper material as a horizontal slit such that two sections of the slit which are divided by an unseen vertical line passing through a middle point of the upper material's horizontal length are symmetrical to each other with respect to the vertical line, the lower material is arranged as being longer than the upper material by a predetermined length, the upper material is arranged such that two sections of the upper material which are divided by an unseen vertical line passing through a middle point of the lower material's horizontal length are symmetrical to each other with respect to the vertical line, the pocket is provided on the lower material, on the surface where the upper material is attached, the take-out opening of the pocket facing toward the center where the take-out slit is provided and arranged as being perpendicular to the slit, while being positioned a little further toward the edge of the pocket tissue holder in the horizontal direction as compared with the edge of the take-out slit, the both edges of the upper material in the vertical direction are attached to the lower material only with respect to portions in between the two take-out openings of the pockets, the upper and the lower materials have both edges in the horizontal direction not attached to each other so that they can serve as supply inlets where tissue papers are inserted, the edge of the upper material in the horizontal direction positioned in between the lower material and the pocket material is pulled out from beneath the pocket material in inserting the tissue papers.

According to an eleventh aspect of the invention, there is provided a pocket tissue holder having a take-out slit for taking out tissue papers, capable of having the tissue papers folded in a predetermined size or form in keeping them inside, comprising: an upper material where a take-out slit is provided from which tissue papers are taken out one by one; a lower material having approximately the same vertical width as that of the upper material, a pocket material which serves to construct together with the lower material a pocket for keeping small goods or articles; wherein, a supply inlet from which tissue papers are inserted is provided at one edge or both edges of the upper material in the vertical direction, the supply inlet positioned a little toward the center from the edge of the upper material in the vertical direction, as being parallel to the take-out slit, the supply inlet provided with a pair of fasteners which open and close the supply inlet at desired times, the pocket materials are provided at both edges of the upper material, the take-out opening of the pocket is facing toward the center where the take-out slit is provided and is arranged as being perpendicular to the slit.

According to a twelfth aspect of the invention, there is provided a pocket tissue holder according to the tenth or the eleventh aspect, wherein: two pairs of fasteners are provided at both edges of the lower surface of the upper material and the upper surface of the lower material in the vertical direction so that the tissue papers kept inside the pocket tissue holder are kept unmoved.

According to a thirteenth aspect of the invention, there is provided a pocket tissue holder according to the eighth or the tenth aspect, wherein: fasteners are provided near the take-out opening of the pocket on the upper surface of the upper material and the lower surface of the pocket material so that they are fastened together to keep the take-out opening of the pocket closed.

According to a fourteenth aspect of the invention, there is provided a pocket tissue holder according to the first aspect, wherein: provided that the upper material is set as an inner side of the pocket tissue holder, and that a single crease or two creases for folding the pocket tissue holder in two or three is/are arranged perpendicular to the take-out slit in the horizontal direction, fasteners are provided at positions where they can be fastened such that the pocket tissue holder would not open loose.

According to a fifteenth aspect of the invention, there is provided a pocket tissue holder according to the fourteenth aspect, wherein: provided that the upper material is set as an inner side of the pocket tissue holder, and that a crease for folding the pocket tissue holder in two is arranged perpendicular to the take-out slit in the horizontal direction, a pair of fasteners are provided at both edges of the pocket tissue holder at the center of the edges with respect to the vertical width so that the fasteners would be fastened together when the pocket tissue holder is folded in two.

According to a sixteenth aspect of the invention, there is provided a pocket tissue holder according to the fourteenth aspect, wherein: provided that the upper material is set as an inner side of the pocket tissue holder, and that two creases for folding the pocket tissue holder in three are arranged perpendicular to the take-out slit in the horizontal direction, one of a pair of fasteners is provided at one edge of the pocket tissue holder at the center of the edge with respect to the vertical width and the other of the pair at a place where the edge of the pocket tissue holder overlaps when the pocket tissue holder is folded in three, so that the fasteners would be fastened together when the pocket tissue holder is folded.

BRIEF DESCRIPTION OF THE DRAWINGS

The above and further objects and the novel feature of the invention will more fully appear from the following detailed description when the same is read in connection with the accompanying drawings, in which.

DESCRIPTION OF THE PREFERRED EMBODIMENTS

Figure 1:
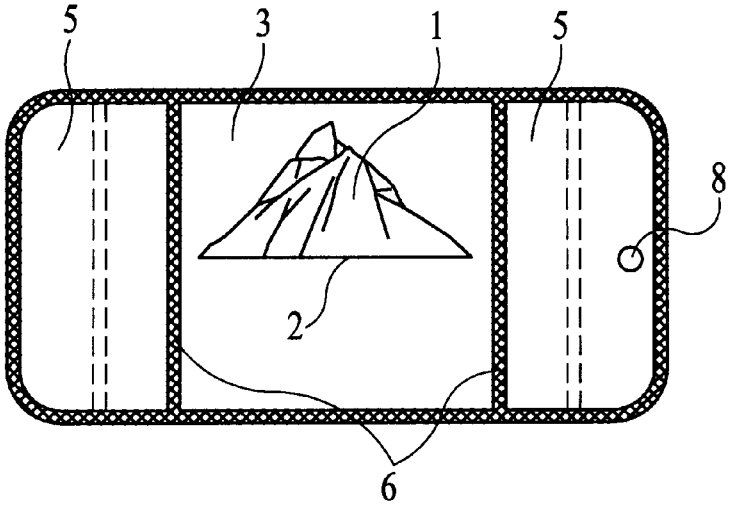
FIG. 1 is a structural diagram showing a pocket tissue holder of a first embodiment of the invention.

Referring now to the drawings, a description of preferred embodiments of the present invention will be given in detail.

With reference to FIGS. 1 to 16, the embodiments of the pocket tissue holder of the present invention will be described.

Figure 2:
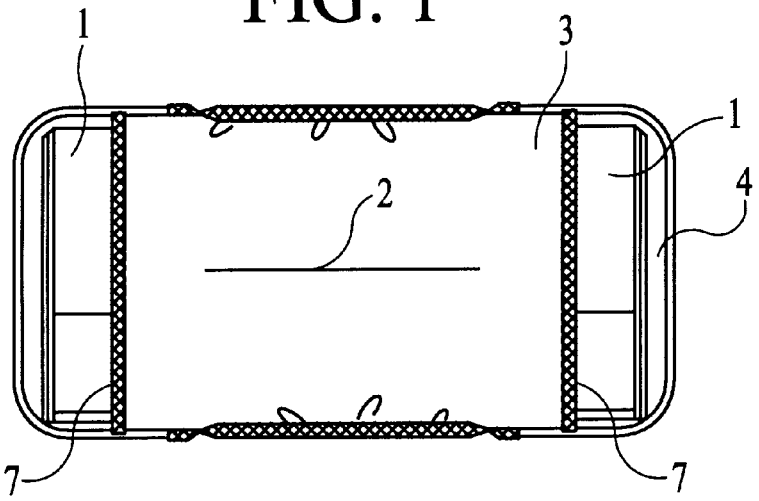
FIG. 2 is a diagram showing a state of the pocket tissue holder in which its pockets are turned inside out.

First of all, a description of the pocket tissue holder of a first embodiment will be given with reference to FIGS. 1 and 2. In FIG. 1, a whole structure of the pocket tissue holder is shown. In FIG. 2, the pocket tissue holder is illustrated as its pockets are turned inside out. As illustrated, according to the pocket tissue holder of the first embodiment, there are provided a material 3 (i.e. an upper material) which is provided with a silt for taking the tissue papers out one by one from a tissue paper container part, and a material 4 (i.e. a lower material) which has approximately the same width as the upper material 3 and which is longer than the upper material 3 by a predetermined length. At the center of the lower material 4, the upper material 3 is fixed by having its both edges (upper and lower edges) in the vertical direction attached to both edges (upper and lower edges) of the lower material 4 in the vertical direction, due to an application of a frame arrangement. In this case, the upper material 3 is fixed so that two sections divided by an unseen vertical line passing through a middle point of the lower material 4's horizontal length are symmetrical to each other with respect to the mentioned vertical line over the middle point. In case of using a folded part of the material, however, only one of the edges should have the frame arrangement. The take-out slit provided on the upper material 3 is arranged so that its two sections divided by an unseen vertical line passing through a middle point of the horizontal length of the upper or lower material are symmetrical to each other with respect to the mentioned vertical line over the middle point.

Figure 3:
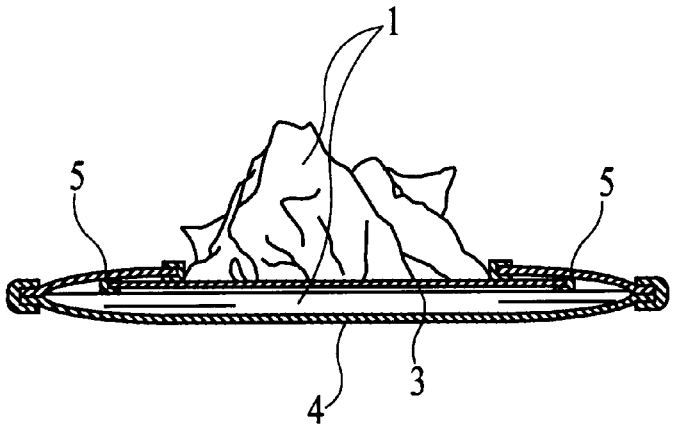
FIG. 3 is a sectional view showing a section of the pocket tissue holder with respect to a horizontal direction.

The edge parts (right and left edge parts) of the upper and lower materials in the horizontal direction are not fixed so that they form opening parts (supply inlets 7) from which tissue papers are inserted. As mentioned above, since the length of the upper material 3 is shorter than that of the lower material 4, it should be understood that the supply inlets 7 are provided a little toward the center with respect to both edges (right and left edges) of the lower material 4 in the horizontal direction. On the upper surface where the supply inlets 7 are positioned, pockets are provided. Those pockets are made of the lower material 4 and pocket materials 5 which have approximately the same widths as the lower material 4. The pocket materials 5 are fixed by frame arrangements at both edges (right and left edges) of the lower material 4 in the horizontal direction. Again in using the folded part of the material, there is no need for any frame arrangement. Take-out openings 6 of the pockets are facing toward the take-out slit provided in the middle. The take-out openings 6 are perpendicular to the take-out slit 2. The positions of the take-out openings 6 with respect to the horizontal direction are more toward the center when compared with the positions of the supply inlets 7, and they are more toward the edges when compared with the position of the take-out slit 2. In FIG. 3, there is shown the way how the pocket materials 5, the upper material 3 and the lower material 4 are arranged with respect to one another. By having edges of the take-out openings 6 overlap with the edges (right and left edges) of the upper material 3 in the horizontal direction, it is possible to have the tissue papers kept inside maintained clean. In addition, the supply inlets open only at times when tissue papers are to be supplied, and thus do not easily open so often.

Figure 4:
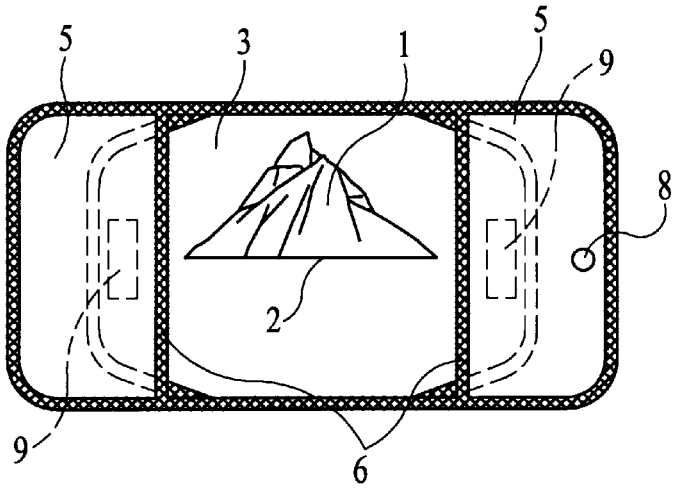
FIG. 4 is a structural diagram showing a pocket tissue holder of a second embodiment of the invention.
Figure 5:
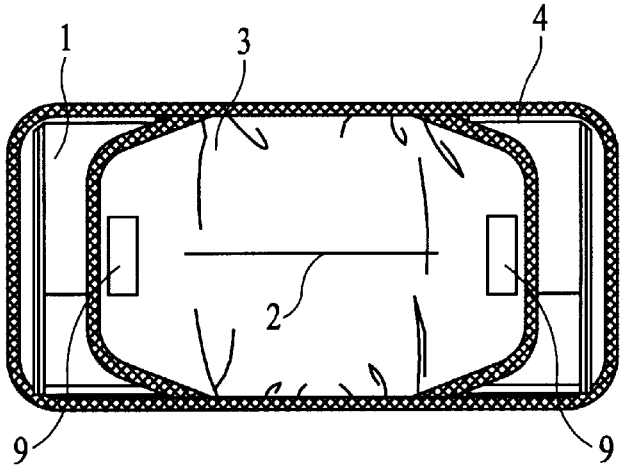
FIG. 5 is a diagram showing a state of the pocket tissue holder in which both edges of an upper material are taken out above surfaces of pockets.

Next, with reference to FIGS. 4 and 5, the pocket tissue holder of a second embodiment of the invention will be described. In FIG. 4, a whole structure of the pocket tissue holder of the second embodiment is illustrated. In FIG. 5, there is illustrated a state in which the edge parts of the upper material 3 is being taken out from the pockets. As in the case of the first embodiment, the tissue container part of the pocket tissue holder of the present embodiment is also constructed by the upper and the lower materials 3 and 4. The take-out slit 2 and the pockets are arranged at the same positions as in the case of the first embodiment. Further, the lengths of the lower material 4 is set to be longer than the upper material 3.

Some of the most notable characteristics of the second embodiment are that, as shown in FIGS. 4 and 5, the edges (upper and lower edges) of the upper material and the lower material in the vertical direction are fixed by frame arrangements as to portions in between two take-out openings 6 of the pockets. The edges (right and left edges) of the lower material 4 and the unfixed edges (right and left edges) of the upper material 3 in the horizontal direction have a wing-like form. In this case, too, when the folded part of the material is used, only one of the edges needs to be fixed by the frame arrangement. When tissue papers are to be inserted to the pocket tissue holder, the edges (right and left edges) of the upper material 3 which are arranged underneath the pocket materials should be taken out, so as to open the supply inlets and insert the tissue papers from one of two gaps formed between the edges of the upper material 3 and the pocket materials. FIG. 5 shows a state in which the tissue papers are inserted in such manner. After having the tissue papers inserted, the edges (right and left edges) of the inserted tissue papers which are exposed to the outside are to be stuffed inside the pockets along with the wing parts (right and left edges) of the upper material 3.

According to the present embodiment, it is possible to easily open and close the supply inlets by pulling the wing parts (right and left edges) of the upper material 3 out from underneath the pocket materials. However, there is one drawback such that the supply inlets can easily open at times other than when tissue papers are inserted. In order to overcome such a flaw, fasteners 9 of some sorts such as flat fasteners or snap fasteners can be applied to where the upper surface of the upper material and the lower surfaces of the pocket materials overlap with one another at two places.

Figure 6:
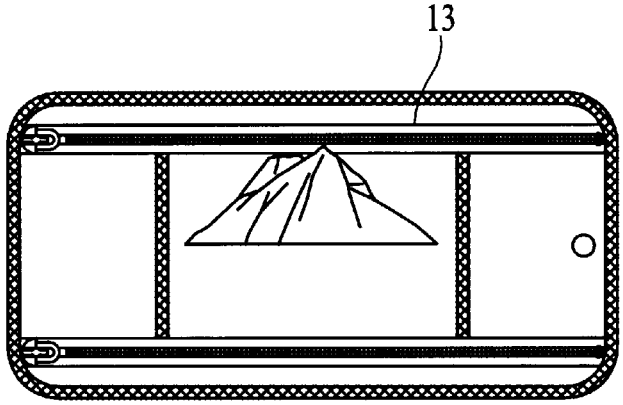
FIG. 6 is a diagram showing a pocket tissue holder of a third embodiment of the invention.

Now referring to FIG. 6, the pocket tissue holder of a third embodiment will be described. As shown in FIG. 6, as with the cases of the first and the second embodiments, the third embodiment has its tissue container part formed by the upper material 3 and the lower material 4. The take-out slit 2 is also arranged at the same position as in the cases of the first and the second embodiments.

One notable characteristic of the third embodiment is that the supply inlets 7 from which tissue papers are supplied are provided at the edges (upper and lower edges) of the pocket tissue holder in the vertical direction. As shown in FIG. 6, the supply inlets 7 range from one edge (right edge) of the pocket tissue holder to the other edge (left edge) of the same, positioned at the edges of the tissue holder in the vertical direction although a little toward the center. For those supply inlets could uncontrollably open and close as the way they are, fasteners (zippers) 13 as shown in FIG. 6 are provided. The lengths of the upper and the lower materials are approximately the same. The edges of both materials in the horizontal direction are attached by a frame arrangement. Further, there are pockets provided at both edges of the upper material in the horizontal direction positioned in between the supply inlets arranged at both edges of the upper material in the vertical direction. Take-out openings of the pockets are facing toward the center where there is a take-out slit, provided as being perpendicular to the take-out slit.

Next, common factors that the above described three embodiments share with one another will be given. The upper material 3, the lower material 4 and the pocket materials 5 are all made of materials such as cloth, a resin film, a special paper etc. according to what the situation demands. As to the encircling frame part and the inner part of the pocket tissue holder, frame arrangements are applied. As to the frame arrangement of the encircling frame part, it is done for the purpose of sawing, gluing and fusing different parts of the material together. On the other hand, with respect to the inner part, the frame arrangement is done so as to prevent the material (i.e. cloth, a resin film, or a special paper) from becoming frayed or be ripped. Accordingly, when the pocket tissue holder is made of a material such as cloth, the frame arrangement could be done by covering the edges of the cloths with a framing tape, by applying piping with a thread-like core inside along the tissue holder's edge, or by simply sawing up the edge parts of the cloths in their reversed sides and turn the sawed piece inside out. In case when a resin film, a special paper or such is used as the base material of the pocket tissue holder, the frame arrangement could be done by adhesion using an adhesive agent, or fusion by heat or high frequency etc. Again by using the folded part of the material, there should be no need for applying the frame arrangement. With respect to the inner part, if the base material is a cloth which is easily frayed, the above mentioned framing tape can be applied inside to prevent the fraying, or the base material can be folded a few times in its edges. In case when the base material (i.e. cloth, a resin film, a special paper etc.) is durable against being frayed or ripped, the frame arrangement does not necessarily have to be applied.

Figure 7:
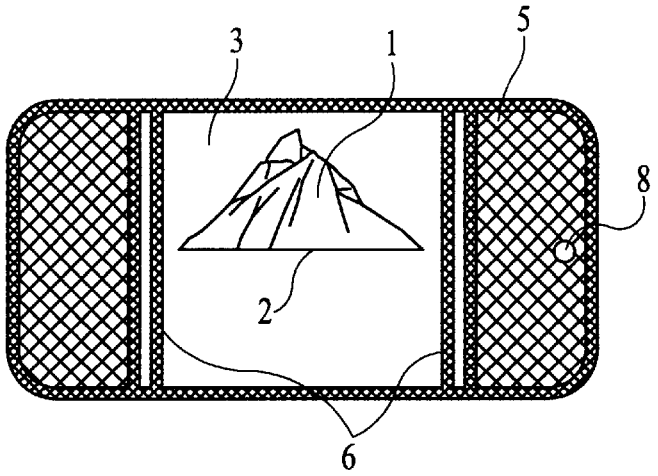
FIG. 7 is a diagram showing a set of examples of pockets of the pocket tissue holder.
Figure 8:
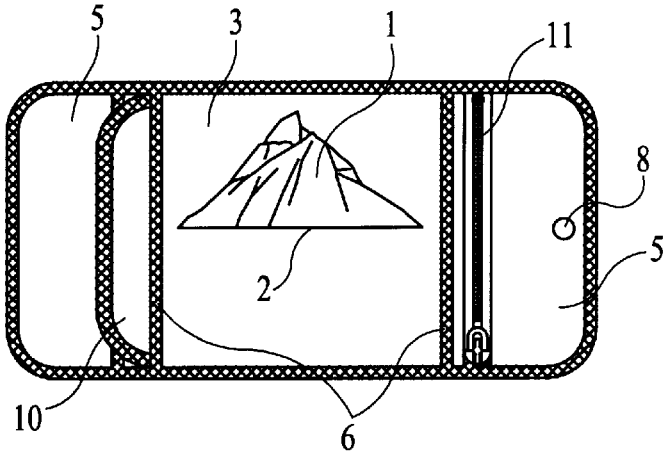
FIG. 8 is a diagram showing another set of examples of the pockets of the pocket tissue holder.

Moreover, in order to prevent the tissue papers from becoming dirty, and enriching the pocket tissue holder's holding capability, there are ways such as increasing the pieces of cloths, resin films, or special papers to be overlapped so as to have the pockets become completely independent from the tissue paper container part, as shown in FIGS. 7 and 8. In this case, materials such as mesh and see-through plastic can be used so that one can see inside the pockets. As to other options, the pocket can be divided into some parts like the right pocket of the pocket tissue holder shown in FIG. 7 by applying stitches, adhesion or fusion, or the pocket can have a flap or a zipper as represented respectively by the left pocket and the right pocket of the pocket tissue holder shown in FIG. 8 so that things kept inside would not fall off. In this way, the pocket tissue holder can have its storing capability be improved.

In case of taking out an infant, when it should be convenient if diapers can be carried along with the tissue papers, the pocket tissue holder can be made a little bigger.

Figure 9:
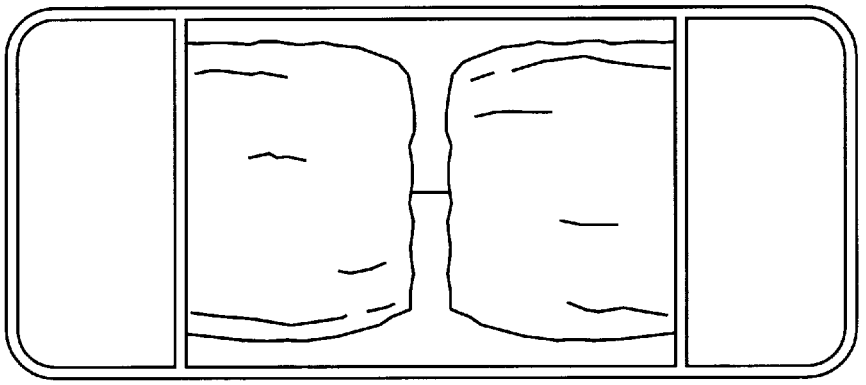
FIG. 9 is a diagram showing a state of the pocket tissue holder in which diapers are kept in the pockets at both edges of the pocket tissue holder.
Figure 10:
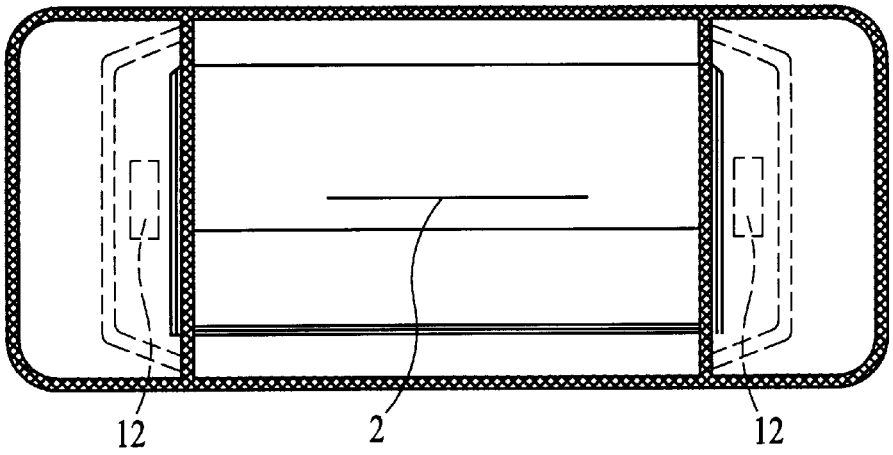
FIG. 10 is a diagram showing positions of fasteners provided so that the tissue papers inside would not move.
Figure 11:
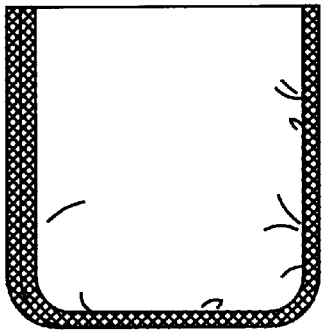
FIG. 11 is a diagram showing a first example as to a way of folding the pocket tissue holder.
Figure 12:
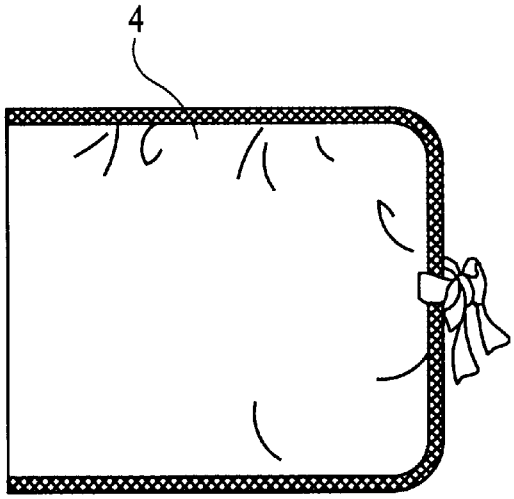
FIG. 12 is a diagram showing a second example as to the way of folding the pocket tissue holder.

In FIG. 9, there is illustrated a case in which diapers are inserted vertically to both pockets of the tissue holder. As can be seen from FIG. 10, for the pocket tissue holder is a little larger than the size of the tissue papers, the tissue papers inside might move. In order to prevent the tissue papers from moving within the pocket tissue holder, fasteners 12 can be provided on the inner surfaces of the upper material and the lower material.

According to the above embodiments, the take-out slit 2 is a 11 cm long silt. When the base material (i.e. cloth, a resin film, a special paper etc.) can be easily frayed, torn or ripped, proper arrangements according to the situation can be applied to the silt in order to prevent the slit from being frayed, torn or ripped.

In accordance with the above embodiments, the pocket tissue holder is folded in two or three. In this case, in order to prevent the tissue holder from becoming unfolded and opening loose, fasteners 8 are provided. The positions of the fasteners should be flexibly determined according to the way the tissue holder is folded. For example, when folding the tissue holder in the middle at a line perpendicular to the horizontal length, the fasteners 8 should be attached to both edges of the tissue holder in the horizontal direction at the center of the edges with respect to the vertical direction. The fasteners to be used here should preferably be ribbons, flat fasteners, snap fasteners etc., which open and close the tissue holder at desired times.

On the other hand, when the pocket tissue holder is of the type for keeping diapers in both pockets as shown in FIG. 9, the pocket tissue holder becomes thick when folded in two. Accordingly, ribbons can be attached to the outer surface of the lower material at its both edges so that they can be tied together such that the tissue holder will not open.

Figure 13:
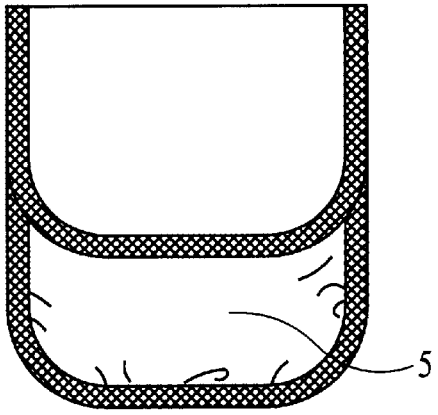
FIG. 13 is a diagram showing a third example as to the way of folding the pocket tissue holder.

When the pocket tissue holder is of the type for keeping a diaper in one pocket and folded in two, as shown in FIG. 13, fasteners 8 such as flat fasteners, snap fasteners etc. are attached to the upper surface of one of the pocket materials at the very edge of the tissue holder in the horizontal direction and to the upper surface of the other pocket material around its take-out opening where two fasteners can overlap with each other to fasten.

Figure 14:
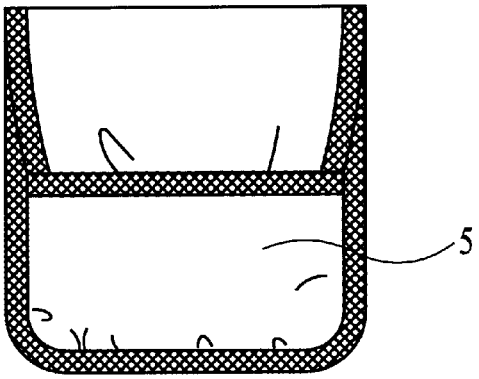
FIG. 14 is a diagram showing a fourth example as to the way of folding the pocket tissue holder.

As shown in FIG. 14, one of other possible options for the way the tissue holder should be folded is that one edge of the tissue holder is inserted to the pocket at the other edge of the tissue holder, so that the pocket will cover the edge to serve as a stopper.

Figure 15:
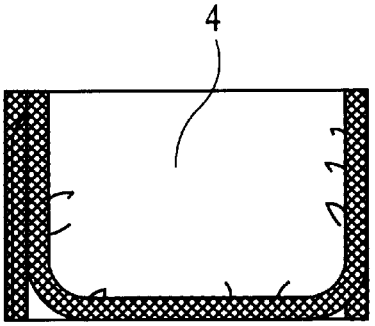
FIG. 15 is a diagram showing a fifth example as to the way of folding the pocket tissue holder.
Figure 16:
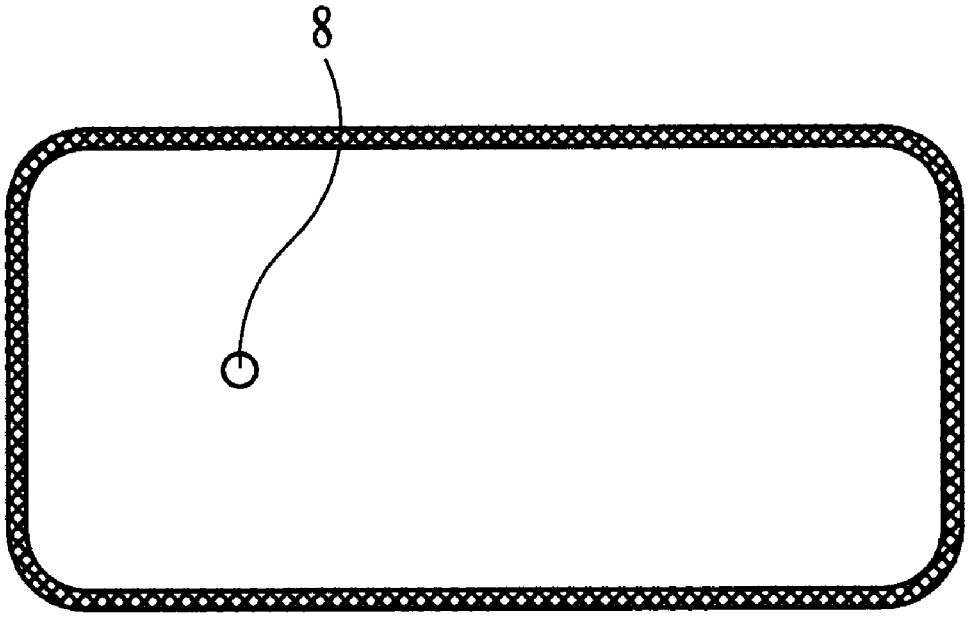
FIG. 16 is a diagram showing a position of a fastener provided so that the pocket tissue holder would not open loose.

In case of folding the pocket tissue holder in three, as illustrated in FIG. 15, as the upper material forming the inner part of the tissue holder and two creases being perpendicular to the take-out slit, the pocket tissue holder can have fasteners (i.e. ribbons, flat fasteners or snap fasteners) at one edge of the pocket tissue holder in the horizontal direction at the center of the edge with respect to the vertical direction and where the edge of the pocket tissue holder overlaps when folding the pocket tissue holder in three. FIG. 16 shows an example in which snap fasteners are used.

In the above described embodiments, the pocket tissue holder is capable of easily holding an arbitrary number of two-folded tissue papers taken out from a tissue box. Since this pocket tissue holder has a simple structure, it can be maintained as flat in its thickness, and by using flexible material, the pocket tissue holder can be folded in two or three to become more compact. It therefore, does not take up much space in carrying, and a considerable amount of tissue papers can be held easily and in a compact way. Moreover, by having fasteners being provided at places where different parts of the material overlap with each other, the tissue holder being folded can be kept fastened and would not easily open. In case when taking out the tissue papers, the tissue papers are in the state of being already unfolded, so that they are ready to be instantly used. What's more, the pockets can keep some additional goods or little articles such as diapers, which serve to provide more conveniences.

While preferred embodiments of the invention have been described using specific terms, such description is for illustrative purposes only, and it is to be understood that changes and variations may be made without departing from the spirit or the scope of the following claims.

What is claimed is:

1. A pocket tissue holder comprising:

an upper member having a length with opposed length edges and a width with opposed width edges;

a take-out slit provided substantially at a center of said upper member, said slit configured for the individual removal of tissue paper sheets therethrough, said slit positioned substantially parallel to said length edges of said upper member;

a lower member having an upper surface and a lower surface, said lower member having a length with opposed length edges, and a width having opposed width edges, said width being approximately the same as the width of said upper member, and said lower member length edges being longer than the length edges of said upper member, said width edges of said upper member being substantially equidistantly positioned from said width edges of said lower member;

a pocket member having a length with opposed length edges and a width with opposed width edges, said width being approximately the same as the width of said lower member, wherein at said upper surface of said lower member, one of said width edges of said pocket member is affixed to one of said width edges of said lower member, and said length edges of said pocket member are affixed to respective portions of said respective length edges of said lower member to form a pocket therewith having an opening, said opening facing said take-out slit; wherein both said length edges of said upper member are respectively attached to another respective portion of said length edges of said lower member;

said width edges of said upper member not being affixed to said lower member, such that said width edges of said upper member form inlets for the acceptance of tissue papers therethrough; and a said width edge of said upper member may be removably tucked into said pocket.

2. The pocket tissue holder according to claim 1, wherein said upper member has an upper surface and a lower surface, said pocket tissue holder further comprising a pair of fasteners, one of said pair of fasteners provided on said lower surface of said upper member, proximate a respective width edge of said upper member, and another of said pair of fasteners provided on said upper surface of said lower member.

3. A pocket tissue holder according to claim 1, wherein said pocket member has an upper surface and a lower surface, said pocket tissue holder further comprising a pair of fasteners positioned proximate said opening of said pocket, one of said pair of fasteners provided on said upper surface of said upper member, and another of said pair of fasteners provided on said lower surface of said pocket member.

* * * * *